US006491251B1

(12) United States Patent
Stanland et al.

(10) Patent No.: US 6,491,251 B1
(45) Date of Patent: Dec. 10, 2002

(54) DOUBLE CORE TISSUE ROLL, DISPENSER AND METHOD

(75) Inventors: Mark Harrison Stanland, Lexington, KY (US); Steven M. Slye, Harrodsburg, KY (US); Douglas E. Bagan, Harrodsburg, KY (US); Alain P. Cotnoir, Danville, KY (US); Randy A. Baughman, Harrodsburg, KY (US); Adam T. Elliott, Lexington, KY (US)

(73) Assignee: Bay West Paper Corporation, Harrodsburg, KY (US)

( * ) Notice: Subject to any disclaimer, the term of this patent is extended or adjusted under 35 U.S.C. 154(b) by 0 days.

(21) Appl. No.: 09/521,834

(22) Filed: Mar. 9, 2000

(51) Int. Cl.[7] ..... B65H 19/00
(52) U.S. Cl. ..... 242/559.2; 242/613
(58) Field of Search ..... 242/559.2, 600, 242/613, 160.4, 160.1

(56) References Cited

U.S. PATENT DOCUMENTS

| | | | | | |
|---|---|---|---|---|---|
| 1,108,855 | A | * | 8/1914 | Simons | 242/600 |
| 1,716,812 | A | * | 6/1929 | Ball | 242/559.2 |
| 2,299,626 | A | | 10/1942 | Hunt | |
| 2,703,681 | A | * | 3/1955 | Jacobs | 242/559.2 |
| 2,726,823 | A | | 12/1955 | Jespersen | |
| 2,905,405 | A | | 9/1959 | Burton et al. | |
| 3,084,006 | A | | 4/1963 | Roemer | |
| 3,085,762 | A | * | 4/1963 | Subklew | 242/559.2 |
| 3,126,234 | A | | 3/1964 | Batlas et al. | |
| 3,211,504 | A | * | 10/1965 | Bump | 242/560 |
| 3,214,014 | A | | 10/1965 | Perrin | |
| 3,294,329 | A | | 12/1966 | Tucker et al. | |
| 3,381,909 | A | | 5/1968 | Tucker et al. | |
| 3,387,902 | A | | 6/1968 | Perrin et al. | |
| 3,433,355 | A | | 3/1969 | Smith | |
| 3,437,388 | A | * | 4/1969 | Jespersen | 242/596.7 |
| 3,650,487 | A | | 3/1972 | Bahnsen | |
| 4,108,513 | A | | 8/1978 | Lander | |
| 4,108,547 | A | * | 8/1978 | Stemmle | 355/50 |
| 4,522,346 | A | | 6/1985 | Jespersen | |
| 4,557,426 | A | | 12/1985 | Siciliano | |
| 4,903,909 | A | * | 2/1990 | Suzuki | 242/559.2 |
| 5,236,141 | A | | 8/1993 | Kewin | |
| 5,310,129 | A | | 5/1994 | Whittington et al. | |
| 5,605,001 | A | * | 2/1997 | Derk | 40/518 |
| 5,636,812 | A | | 6/1997 | Conner et al. | |
| 5,749,538 | A | | 5/1998 | Brown et al. | |
| 5,829,713 | A | | 11/1998 | Kewin | |
| 5,833,169 | A | | 11/1998 | Morand | |

FOREIGN PATENT DOCUMENTS

| | | | | |
|---|---|---|---|---|
| GB | 2245882 | * | 1/1992 | 242/559.2 |
| NL | 8602194 | * | 3/1988 | 242/559.2 |

* cited by examiner

*Primary Examiner*—Emmanuel M. Marcelo
(74) *Attorney, Agent, or Firm*—Merchant & Gould P.C.

(57) ABSTRACT

An improved web material dispenser that is designed to dispense web material, such as toilet tissue or the like. The dispenser is able to retain a roll containing tissue at a dispensing position until the tissue has been exhausted from the roll. The dispenser senses that the tissue is exhausted from the roll, and only then permits a reserve roll to be rotated into a dispensing position. Thus, the dispenser ensures that the tissue from each roll is used up before permitting access to a reserve roll. The invention also provides a new web material roll that utilizes a "double core", as well as a method of making the "double core".

21 Claims, 5 Drawing Sheets

DOUBLE CORE TISSUE ROLL, DISPENSER AND METHOD

FIELD

This invention relates to the dispensing of web material such as toilet tissue, paper towels and the like, from rolls of web material contained within a dispenser. This invention further relates to improved rolls that contain web material for use with a dispenser, and to methods of forming such rolls. The inventive concepts will be described hereinafter primarily in relation to toilet tissue dispensers and toilet tissue rolls. It is to be realized that the inventive concepts described herein have applications to other types of web materials in addition to toilet tissue, including, but not limited to, paper towels.

BACKGROUND

There has been continuing effort over the years to provide toilet tissue dispensers that store multiple rolls of toilet tissue and sequentially dispense the rolls. One of the advantages provided by these types of dispensers is that a reserve roll (or rolls) is available as a replacement for the roll that is currently in use.

To avoid tissue waste, it is important that the roll currently in use be depleted to its fullest extent before allowing the user to access a replacement roll. Devices that attempt to achieve such a result using a variety of methods are known in the prior art, as exemplified in U.S. Pat. Nos. 3,294,329; 3,381,909; 3,387,902; 4,108,513; 4,522,346; 4,577,426; 5,310,129; 5,636,812; and 5,749,538.

There is, however, a continuing need for improved toilet tissue dispensers that inhibit access to a replacement roll until the roll currently in use is depleted.

SUMMARY

The invention provides an improved web material dispenser that is designed to dispense web material, such as toilet tissue or the like. The web material dispenser comprises a housing, with a spider rotatably mounted within the housing for rotation about an axis extending through a center of the spider. A plurality of spools are connected to the spider and project therefrom in a direction parallel to the rotation of the spider axis. The spools are rotatable with the spider along a rotational path spaced from the axis. A core stop is fixed to the housing, with the core stop crossing the rotational path of the spools to prevent rotation of the spider until the tissue has been substantially depleted or exhausted from the roll.

In addition to the web material dispenser, the invention provides an improved web material roll for use in the inventive web material dispenser described herein or in other web material dispensers, as well as a method of making the roll.

In one version as claimed, a web material roll includes first and second core sections, with the core sections being spaced apart from each other to define a gap therebetween. In addition, a web material is wound onto the core sections.

A method of forming a core for this type of web material roll comprises providing an elongate, generally cylindrical tube having a longitudinal axis; cutting the tube into a plurality of generally cylindrical sections, with each of the sections having a length approximately equal to a width of web material to be wound onto the roll; and removing a predetermined length from proximate the center of at least one of the sections to form first and second core sections, whereby the combined length of the first and second core sections is less than the width of the web material to be wound thereon.

These and various other advantages and features of novelty which characterize the invention are pointed out with particularity in the claims annexed hereto and forming a part hereof. However, for a better understanding of the invention, its advantages and objects obtained by its use, reference should be made to the drawings which form a further part hereof, and to the accompanying description, in which there is described a preferred embodiment of the invention.

DETAILED DESCRIPTION

The web material rolls and the methods of making the rolls will first be described by referring to FIGS. 10–12. The web material roll and related method described herein are specifically directed to rolls of toilet tissue. However, it is to be realized that the inventive concepts could be used in relation to other types of web material rolls that have a core and a web material wound onto the core, such as paper towel rolls. In addition, the inventive web material rolls are described as being used on the inventive web material dispensers described herein. It is to be realized that the web material rolls could be used with other types of web material dispensers in addition to the dispensers described herein.

Figure 10:
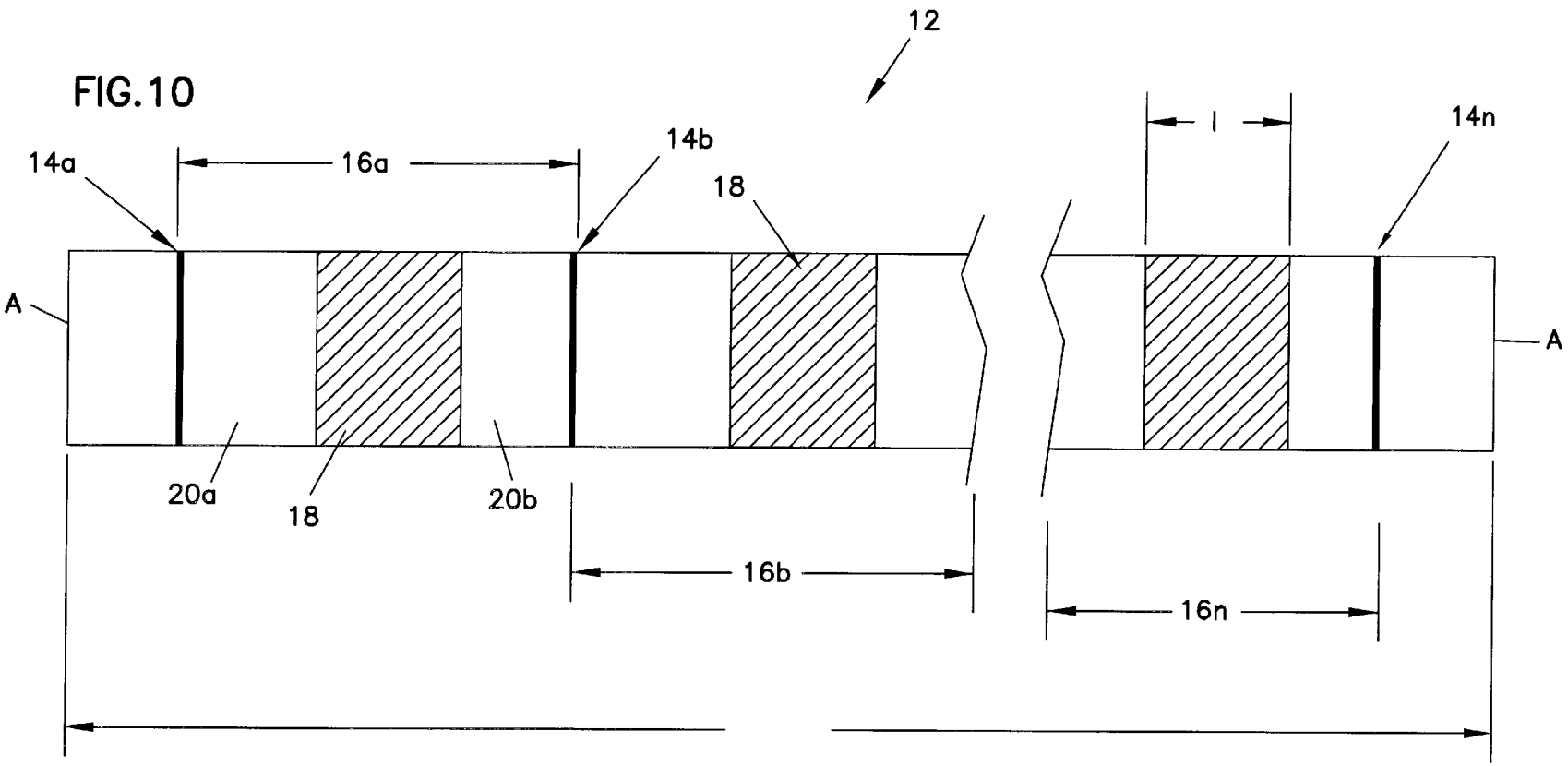
FIG. 10 illustrates a tube that is used to form the core of the web material roll.
Figure 12:
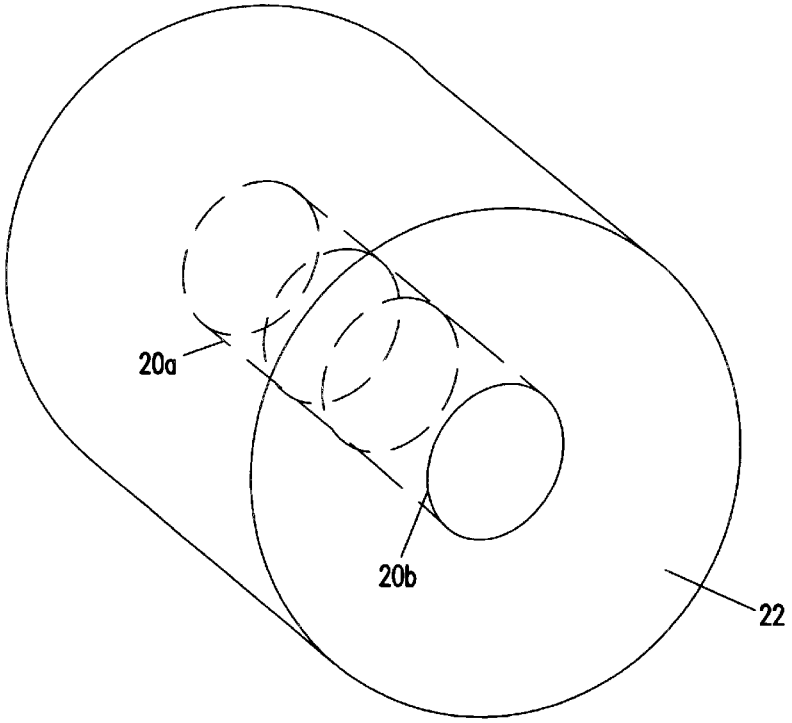
FIGS. 11 and 12 are a side view and a perspective view, respectively, of the web material roll utilizing a core that is formed from the tube in FIG. 10.
Figure 11:
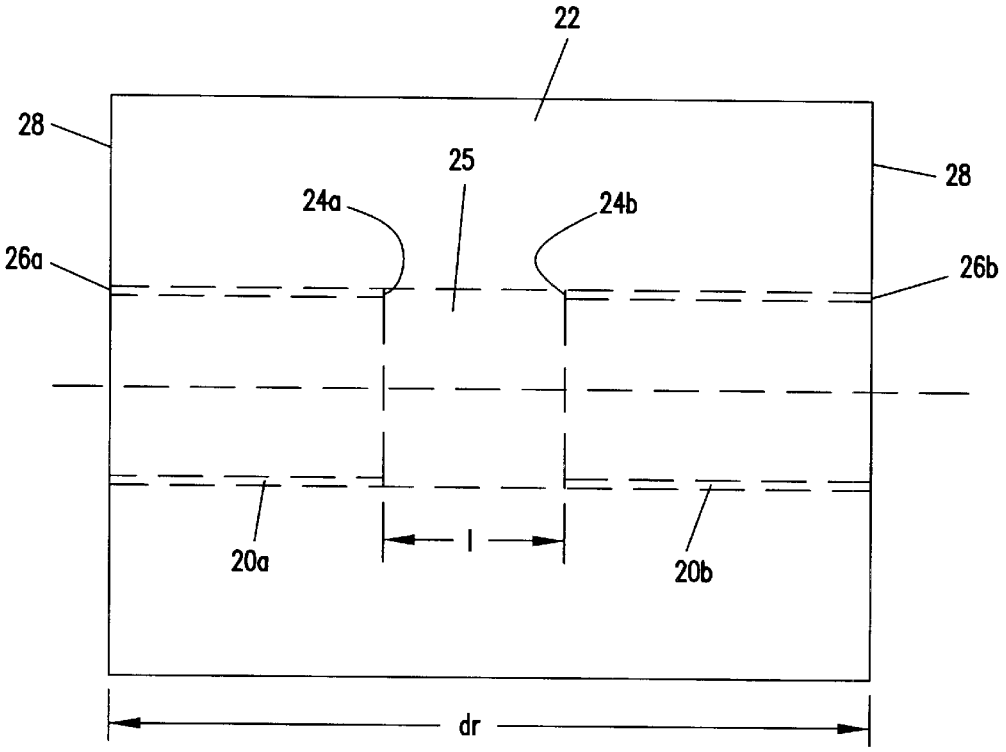

FIGS. 10–12 illustrate the toilet tissue roll and method of forming the core thereof. This roll uses what can be referred to as a "double core". Initially, as illustrated in FIG. 10, an elongate, generally cylindrical tube 12 having a longitudinal axis A—A is provided. The tube 12 is then cut at points 14*a*, 14*b*, . . . 14*n* to form a plurality of equal length sections 16*a*, 16*b*, . . . 16*n* having a width approximately equal to the width of toilet tissue. A portion 18 (shown in hatched lines) proximate the center of each section 16*a–n* is then removed by cutting to form core two core sections 20*a,* 20*b*. The combined length of the core sections 20*a,* 20*b* is thus less than the width of the toilet tissue to be wound onto the core sections 20*a,* 20*b*. In one implementation, the portion 18 that is removed from each section 16*a–n* preferably has a length l of approximately 2.0 ,inches, so that the combined length of the core sections 20*a,* 20*b* is approximately 2.0 inches shorter in length than the tissue to be wound thereon. The tube 12 can have any convenient length from which a plurality of core sections can be formed, such as a length of approximately 115.0 inches.

Once the core sections 20*a,* 20*b* are formed, toilet tissue 22 is wound onto the core sections 20*a,* 20*b* with the core sections 20*a,* 20*b* being spaced apart from each other, as is evident from FIGS. 11 and 12 which illustrate a subsequently formed toilet tissue roll. As is further evident from FIGS. 11 and 12, the core sections 20*a,* 20*b* include ends 24*a,* 24*b* that face each other and which are spaced apart by approximately the distance I thereby forming a gap 25. The core sections 20*a,* 20*b* further include ends 26*a,* 26*b* that are even with the opposite side surfaces 28 of the tissue 22. Thus, there is a portion of the tissue 22 approximately midway between the side surfaces 28 that is not core supported due to the gap 25 between the ends 24*a,* 24*b* of the core sections 20*a,* 20*b*. The gap 25 between the core sections 20*a,* 20*b* remains until such time as the tissue 22 is substantially depleted from the roll.

As will be described below, the gap 25 between the core sections 20*a,* 20*b* facilitates sensing that the tissue is substantially depleted or exhausted from the roll. It is to be realized that the core sections 20*a,* 20*b* could be formed using methods other than that described above. For instance, instead of removing a single portion at the center of each section, portions could be removed from each end of a section and the section then cut in half to thereby form the core sections.

Figure 1:
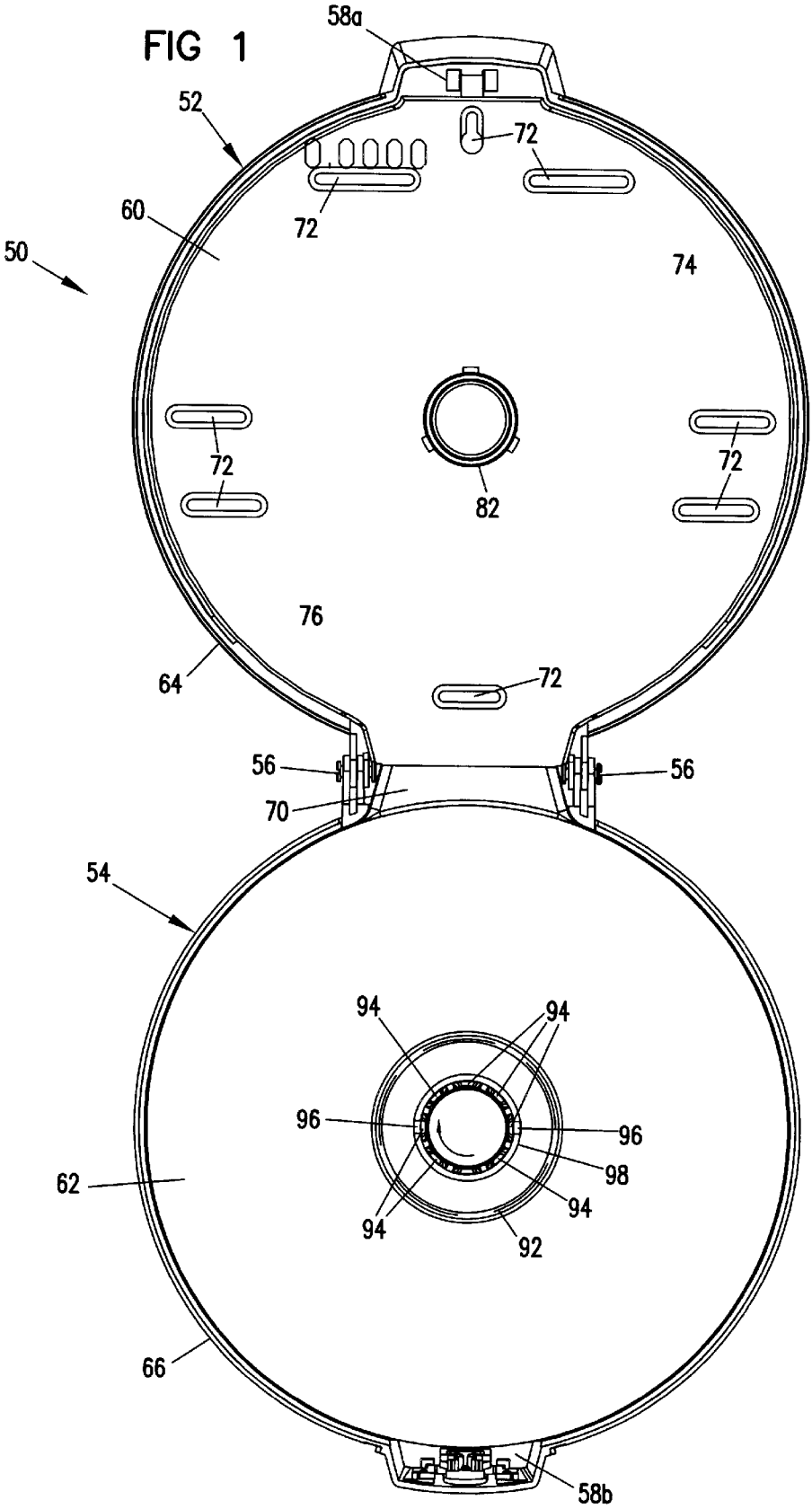
FIG. 1 is a front view of the web material dispenser, with the front housing portion open relative to the rear housing portion to show the interiors thereof and with the spider and core stop removed from the rear housing portion.

One implementation of a web material dispenser 50 is illustrated in FIGS. 1–5. With reference to FIG. 1, the dispenser 50 includes a rear housing portion 52 and a front housing portion 54 pivotally connected to the rear housing portion 52 at the bottom ends thereof via pivots 56. The housing portions 52, 54 include cooperating locking structures 58*a,* 58*b* at the top ends thereof, by which the housing portions 52, 54 can be locked together to form an enclosure for a plurality of rolls of toilet tissue.

The housing portions 52, 54 are generally circular in shape, with each including a generally circular end wall 60, 62 and a generally circular sidewall 64, 66. The end walls 60, 62 and sidewalls 64, 66 combine to form an interior space when the housing portion 54 is pivoted upward from the position shown in FIG. 1 and connected to rear housing portion 52, via the locking structures 58*a,* 58*b*. When the housing portions 52, 54 are locked together, the end walls 60, 62 face each other and the sidewalls 64, 66 fit together to form an enclosure. A dispensing opening 70 is formed by the sidewalls 64, 66 at the bottoms thereof through which tissue from one of the tissue rolls is dispensed.

The end wall 60 of the housing portion 52 is further provided with a plurality of slots 72 by which the housing portion 52 can be mounted to a wall or other fixed structure using bolts, screws or other suitable fasteners.

Figure 4:
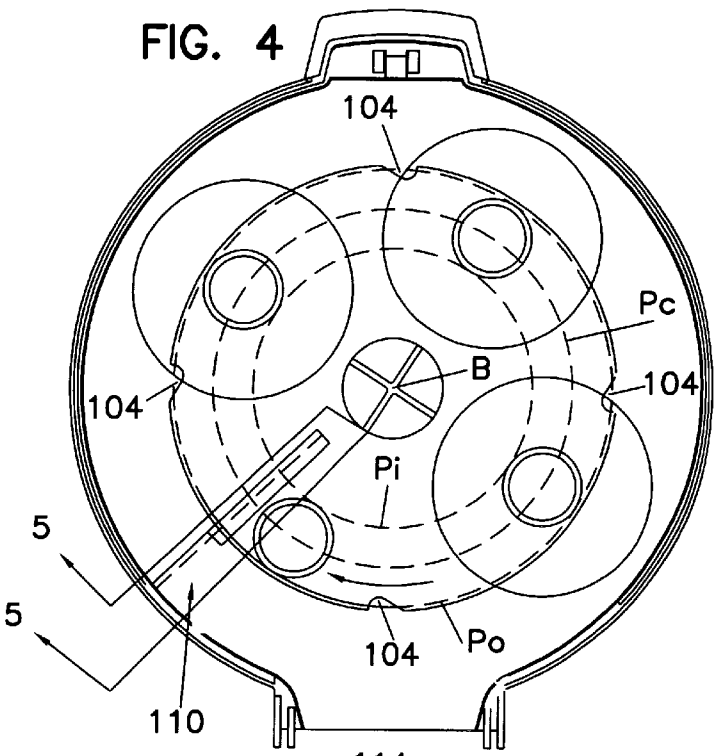
FIG. 4 is a view similar to FIG. 2 showing rotation of the spider upon depletion of the web material from the roll at the dispensing position.
Figure 2:
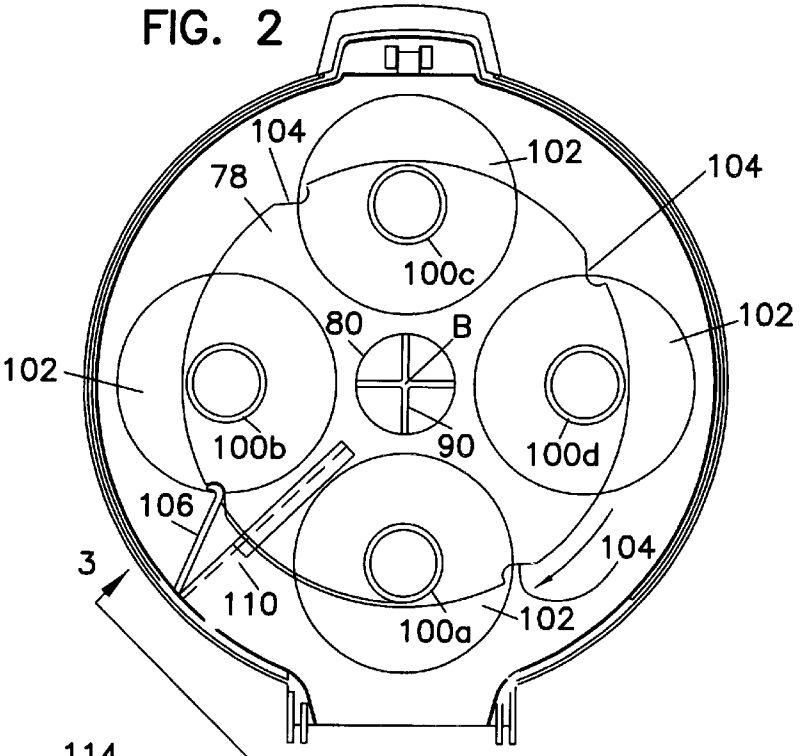
FIG. 2 is a front view of the rear housing portion showing the spider and core stop.

With reference to FIGS. 2 and 4, a spider 78 is rotatably mounted on the rear housing portion 52 for rotation about a central axis B in a clockwise direction as shown by the arrows in FIGS. 2 and 4. The spider 78 is generally circular in shape and includes a central boss 80 projecting from the center thereof parallel to the rotation axis B and toward the front housing portion 54. The boss 80 is sized to rotatably fit over a cylindrical hub 82 (best seen in FIG. 1) that projects from the end wall 60 of the rear housing portion 52 in the direction of the axis B. The boss 80 and hub 82 are preferably secured together via a snap fit connection that detachably connects the boss 80 and hub 82 together while permitting rotation of the boss 80, and thus the spider 78, on the hub 82.

In addition, an x-shaped formation 90, visible in FIGS. 1, 2 and 4, projects from the top end of the boss 80. Further, an actuation disk 92, shown in dashed lines in FIG. 1, is rotatably mounted on the front housing portion 54. The disk 92 is disposed on the exterior side of the end wall 62 whereby the disk is accessible from outside the housing 52, 54 by a user in order to rotate the spider 78. A plurality of circumferentially spaced fingers 94 project rearwardly from the disk 92 toward the rear housing portion 52, with a gap between each adjacent finger 94. The x-shaped formation 90 and the fingers 94 are sized such that they engage when the front housing portion 54 is pivoted to the closed position relative to the rear housing portion 52, with x-shaped formation 90 disposed within the gaps between the fingers 94. With this construction, rotation of the disk 92 causes rotation of the spider 78. A pair of diametrically opposite fingers 94 each include a shoulder 96 formed thereon which fit over a boss 98 projecting from the interior surface of the end wall 62 so as to rotatably secure the disk 92 to the end wall 62.

Returning to FIGS. 2 and 4, the spider 78 is shown to include a plurality of spools 100*a–d,* in this instance four spools, projecting from the spider 78 parallel to the axis B, with the spools disposed adjacent to the circumference of the spider 78. The spools 100*a–d* are spaced at 90 degree intervals around the spider 78. However, it would be possible to use a larger or lesser number of spools, depending upon the size of the tissue rolls and the needs of the consumer, in which case the spools would be spaced at intervals of 360 degrees divided by the number of spools. Each spool 100*a–d* is sized to receive thereon a tissue roll 102.

As shown in FIGS. 2 and 4, the circumference of the spider 78 is provided with a plurality of detents 104. Preferably, there is one detent 104 for each spool 100*a–d* disposed on the spider 78. A resilient indexing finger 106 is fixed at a first end thereof to the rear housing portion 52 and the second end thereof extends toward the spider for engagement within one of the detents 104. When the end of the finger 106 engages in a detent 104, rotation of the spider 78 in a counterclockwise direction is prevented, and one roll 102 is held at a dispensing position while a second roll 102 is at a reserve position (see FIG. 2). However, rotation of the spider 78 in a clockwise direction is selectively permitted, as described below.

A core stop 110 is further fixed to the rear housing portion 52 and extends along a radial axis toward the boss 80 of the spider 78 and into the rotation path of the spools 100*a–d* and rolls 102. The rotation path of the spools 100*a–d* is shown in dashed lines in FIG. 4, and includes an outer rotation path $P_o$ defined by the radially outermost point of the spools 100*a–d* as the spider rotates, an inner rotation path $P_i$ defined by the radially innermost point of the spools, and a central rotation path $P_c$ defined by the central point of the spools. As used herein, rotation path is meant to include at least one of the paths $P_o$, $P_c$, and $P_i$.

Figure 5:
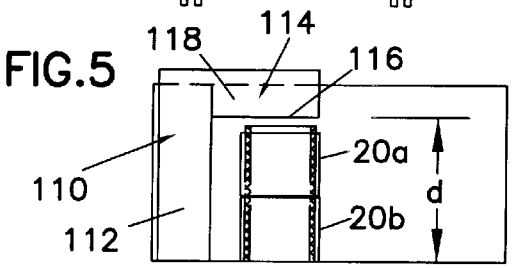
FIG. 5 is a cross-sectional view of the core stop and core taken along line 5—5 in FIG. 4.

The core stop 110, as best seen in FIG. 5, includes a first portion 112 extending parallel to the spools 100*a–d* and a second portion 114 that extends perpendicular to the spools. The second portion 114 extends toward and crosses the outer, central and inner rotation paths of the spools 100*a–d* and includes a bottom edge 116 that is spaced a distance d above the spider 78. Further, as illustrated in FIG. 3, the second portion 114 includes a front surface 118 that is sloped toward the bottom edge 116 in the direction of rotation of the spider 78.

With reference to FIGS. 2–5, a "double core" type of roll, such as the roll described in FIGS. 11 and 12, is loaded onto each spool 100*a–d*. The rolls 102 are shown as being mounted onto the spools 100*a–d* such that the core sections 20*a* are above the core sections 20*b*. However, the rolls 102 could be mounted such that the core sections 20*b* are positioned above the core sections 20*a*.

Figure 3:
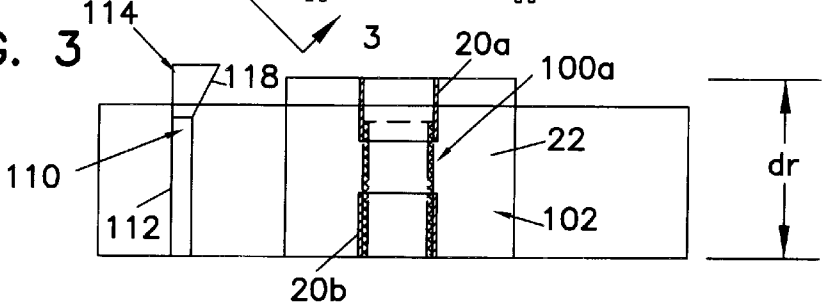
FIG. 3 is a side view of the core stop and the roll at the dispensing position, viewed generally in the direction 3—3 in FIG. 2.
Figure 8:
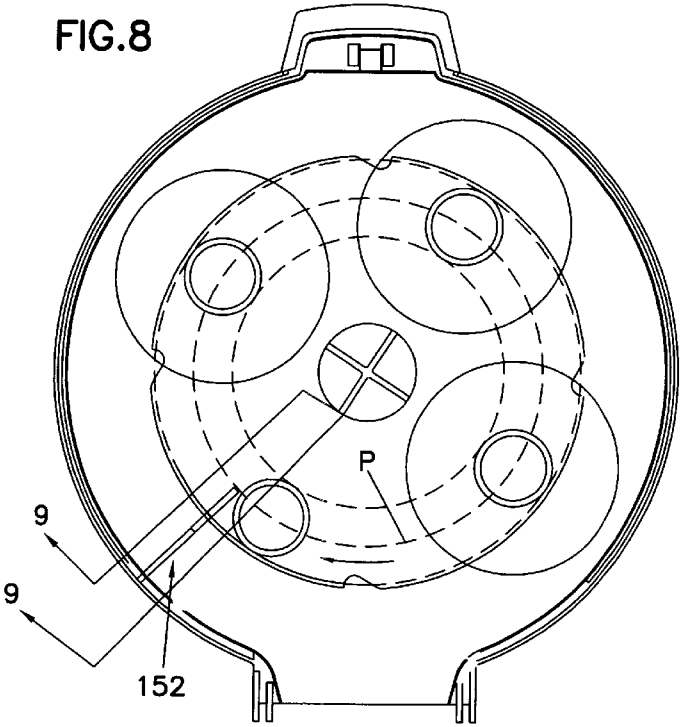
FIG. 8 is a view similar to FIG. 6 showing rotation of the spider upon depletion of the web. material from the roll at the dispensing position.

As shown in FIG. 3, the distance $d_r$ between the side surfaces 28 of the tissue 22 is greater than the distance d between the bottom edge 116 of the second portion 114 of the core stop 110 and the spider 78. Thus, the tissue 22 will contact the second portion 114 of the core stop 110, if a user tries to rotate the spider 78, and thereby prevent clockwise rotation of the spider 78. The tissue 22 will retain the core sections 20*a*, 20*b* in their spaced apart condition until such time as the tissue 22 has been substaritially depleted or exhausted from the roll, and rotation of the spider 78 will be prevented. It is important to realize that the distance d is greater than the length of the spools 100*a–d*, as evident from FIG. 5, such that, during rotation of the spider 78, the spools can travel under the bottom edge 116 of the core stop 110.

However, referring to FIGS. 4 and 5, once the tissue 22 has been substantially depleted or exhausted, if a user rotates the spider 78 in a clockwise direction, the angled front surface 118 will cause the core section 20*a* to be forced downward toward the core section 20*b*. Thus, as evident from FIG. 5, the core sections 20*a*, 20*b* and the spool 100*a* can travel under the bottom edge 116 to permit the spider 78 to be rotated so as to bring the next reserve tissue roll into the dispensing position.

Thus, the core stop 110 acts as a means for sensing that the tissue has been exhausted from the roll currently at the dispensing position. Once the tissue has been exhausted, the spider can be manually rotated in the clockwise direction to bring the reserve roll to the dispensing position. Since the reserve roll has tissue thereon, the tissue contacts the core stop 110 and prevents further rotation of the spider until the reserve roll is itself exhausted of tissue.

FIGS. 6–9 illustrate another embodiment of a dispenser 150. The dispenser 150 is similar to the dispenser 50 of FIGS. 1–5, except that the dispenser 150 uses a different core stop 152. The core stop 152 in FIGS. 6–9 is configured to function with the gap 25 between the core sections 20*a*, 20*b* in order to sense the depletion of tissue from the roll.

Figure 9:
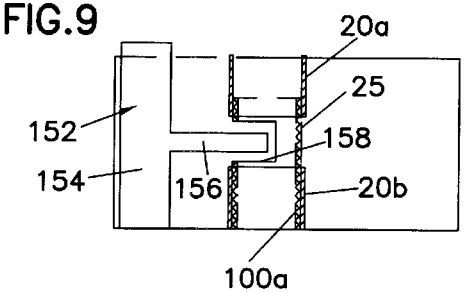
FIG. 9 is a cross-sectional view of the core stop and core taken along line 9—9 in FIG. 8.
Figure 6:
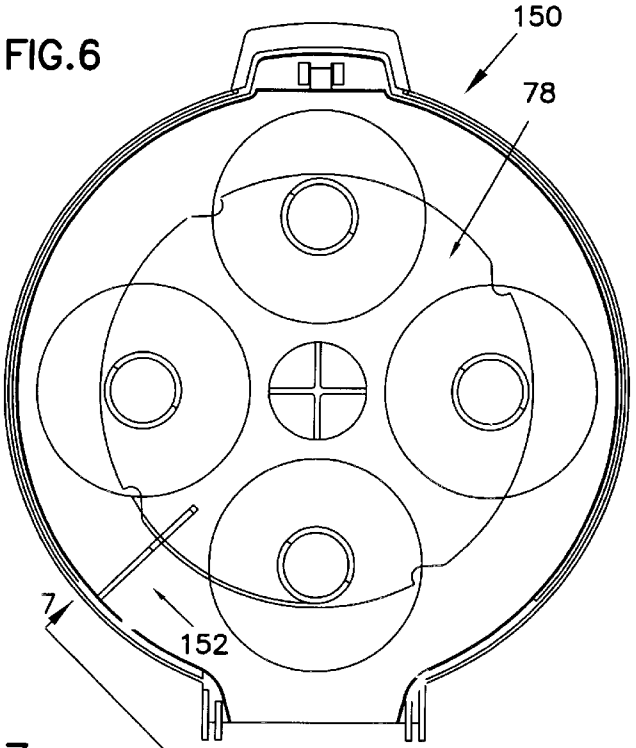
FIG. 6 illustrates a dispenser using a second embodiment of a core stop.
Figure 7:
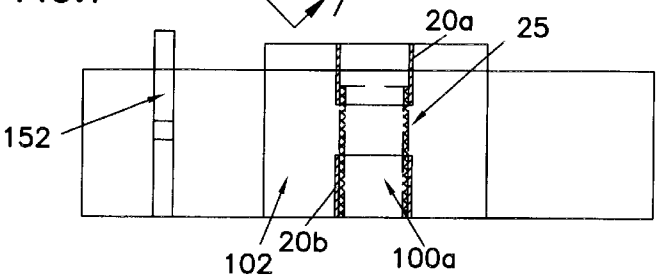
FIG. 7 is a side view of the core stop and the roll at the dispensing position, viewed generally in the direction 7—7 in FIG. 6.

With reference to FIG. 9, it is seen that the core stop 152 includes a vertical portion 154 extending parallel to the spools. A finger 156 projects from the vertical portion 154 approximately midway along the length thereof, and extends along a radial axis toward the boss 80 of the spider 78. In this embodiment, the distal end of the finger 156 preferably extends at least past the outer rotation path $P_o$ defined by the radially outermost point of the spools 100*a–d*, but no further than the central rotation path $P_c$. Preferably, the end of the finger is located adjacent the central rotation path, although the end could be located between the outer and central paths as well. Each spool 100*a–d* is formed with a cut-out 158 that, when a roll 102 is mounted on each spool, is positioned adjacent the gap 25. The cut-out 158 is defined over approximately one-half of the circumference of each spool.

The core stop 152 functions as follows. When tissue 22 in the roll 102, the tissue 22 will contact the finger 156 and rotation of the spider 78 is prevented. The spider will be prevented from rotating as long as tissue remains on the roll. However, once the tissue 22 has been substantially depleted or exhausted, the cut-out 158 will be uncovered, and the finger 156 can then pass through the cut-out 158 in the spool 100*a* to permit rotation of the spider to bring the next reserve roll to the dispensing position. Thus, in this embodiment, the core sections 20*a*, 20*b* remain generally spaced apart.

It is contemplated that rotation of the spider 78 could be caused by a user when a small amount of tissue remains on the roll, in which case sufficient force would need to be applied to overcome the force of the tissue that remains covering the gap 25 and the cut-out 158. Under most circumstances, the force required to produce such a rotation would be sufficiently large so as to deter rotation until the tissue has been substantially depleted or exhausted.

It is to be realized that the dispensers 50, 150 described herein could be utilized with tissue rolls other than those described herein and still be in accordance with the principles of the invention. Furthermore, the tissue rolls described herein could be utilized on dispensers other than those described herein and still be in accordance with the principles of the invention.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A method of forming a core for a web material roll, comprising:

providing an elongate, generally cylindrical tube having a longitudinal axis;

cutting the tube into a plurality of generally cylindrical sections, each of said sections having a length approximately equal to a width of web material to be wound onto the roll; and removing a predetermined length from proximate the center of at least one of said sections to form first and second core sections, whereby the combined length of the first and second core sections is less than the width of the web material to be wound thereon.

2. A web material dispenser, comprising:

a housing;

a spider rotatably mounted within the housing, said spider rotatable about an axis extending through a center of the spider;

a plurality of spools connected to said spider and projecting therefrom in a direction parallel to said axis, said spools being rotatable with said spider along a rotation path spaced from said axis; and a stop fixed to said housing, said stop configured to cross the rotation path of said spools to engage web material on a web material roll disposed on one of said spools to sense depletion of the web material and permit rotation of said spider when the web material becomes depleted.

3. The web material dispenser according to claim 2, wherein said stop includes a first portion extending parallel to said spools and a second portion extending perpendicular to said first portion and to said spools, said second portion extending toward and crossing a central rotation path of said spools.

4. The web material dispenser according to claim 3, wherein said spools each include a distal end spaced from said spider, and said second portion is spaced from the distal ends of said spools whereby said spools are able to rotate under said second portion.

5. The web material dispenser according to claim 4, wherein each said spool is configured to receive a web material roll thereon, at least one of said web material rolls including first and second core sections, said core sections being spaced apart from each other defining a gap therebetween, and further including a web material wound onto said core sections; wherein the web material wound onto the core sections has side surfaces defining a first distance therebetween, and wherein said first and second core sections have a combined length that is less than said first distance.

6. The web material dispenser according to claim 5, wherein said second portion has a bottom edge that is positioned above the spider a second distance, said second distance being greater than the combined length of said first and second core sections and said second distance being less than said first distance.

7. The web material dispenser according to claim 2, wherein said includes a first portion extending parallel to said spools and a second portion extending perpendicular to said first portion and to said spools, said second portion extending toward and crossing an outer rotation path of said spools.

8. The web material dispenser according to claim 7, wherein said second portion does not cross a central rotation path of said spools.

9. The web material dispenser according to claim 7, wherein said second portion includes an end that is located adjacent to a central rotation path of said spools.

10. The web material dispenser according to claim 7, wherein at least one of said spools includes a cut-out that is positioned to permit passage of said second portion therethrough.

11. The web material dispenser according to claim 10, wherein each said spool is configured to receive a web material roll thereon, and wherein at least one of said web material rolls includes first and second core sections, said core sections being spaced apart from each other defining a gap therebetween, and further including a web material wound onto said core sections; and wherein said cut-out is positioned within said gap when the at least one web material roll is positioned on the spool.

12. A web material dispenser, comprising:

a housing;

a spider rotatably mounted within the housing, said spider rotatable about an axis extending through a center of the spider;

a plurality of spools connected to said spider and projecting therefrom in a direction parallel to said axis, said spools being rotatable with said spider along a rotation path spaced from said axis; and a stop fixed to said housing, said stop including a first portion extending parallel to said spools and a second portion extending perpendicular to said first portion and to said spools, said second portion extending toward and crossing a central rotation path of said spools.

13. A web material dispenser, comprising:

a housing;

a spider rotatably mounted within the housing, said spider rotatable about an axis extending through a center of the spider;

a plurality of spools connected to said spider and projecting therefrom in a direction parallel to said axis, said spools being rotatable with said spider along a rotation path spaced from said axis; and a stop fixed to said housing, said stop including a first portion extending parallel to said spools and a second portion extending perpendicular to said first portion and to said spools, said second portion extending toward and crossing an outer rotation path of said spools.

14. A method of forming a roll of toilet tissue, comprising:

providing an elongate, generally cylindrical tube having a longitudinal axis;

forming a plurality of generally cylindrical core sections from said tube, at least two of said core sections having a combined length that is less than the width of toilet tissue to be wound onto the two core sections;

aligning and separating said two core sections such that longitudinal axes of said core sections are colinear and there is a gap between said two core sections; and winding toilet tissue onto said two core sections.

15. The method of claim 14, wherein said two core sections are separated such that the combined length of said two core sections and said gap is equal to the width of said toilet tissue.

16. The method of claim 14, wherein said two core sections each have the same length.

17. A roll of toilet tissue produced according to the method of claim 14.

18. A method of using a toilet tissue roll having first and second colinear core sections spaced apart from each other defining a gap therebetween, and toilet tissue wound onto said core sections and simultaneously contacting each said core section, the method comprising:

mounting the roll in a dispenser to dispense the toilet tissue, said dispenser including a sensing mechanism tat senses the toilet tissue; and maintaining a substantially colinear relationship of the first and second core sections within the dispenser when the sensing mechanism senses substantial depletion of the toilet tissue.

19. A combination comprising:

a web material roll comprising first and second core sections, said core sections being spaced apart from each other defining a gap therebetween, and a web material wound onto said core sections and simultaneously contacting each said core section; and a web material dispenser that dispenses said web material from said roll, said dispenser including a housing, a spool mounted within said housing and rotatable relative to said housing along a rotation path and that receives said roll thereon, a sensing mechanism that engages said web material on said roll to prevent rotation of said spool along said rotation path;

and wherein said gap permits rotation of said spool along said rotation path when said sensing mechanism senses a sufficient depletion of said web material from said roll.

20. The combination of claim 19, wherein said sensing mechanism comprises a stop that includes a first portion extending parallel to said spool and a second portion extending perpendicularly to said first portion, said second portion is positioned to engage said web material, and said second portion is design to force one said core section toward the other said core section when said web material has been sufficiently depleted.

21. The combination of claim 19, wherein said sensing mechanism comprises a stop that includes a first portion extending parallel to said spool and a second portion extending perpendicularly to said first portion, said second portion is positioned to engage said web material, and said second portion extends into said gap when said web material has been sufficiently depleted.

* * * * *